United States Patent [19]

Hager et al.

[11] 4,312,388

[45] Jan. 26, 1982

[54] DUST CONTROL APPARATUS AND METHOD OF TRANSFERRING DUST LADEN DISCRETE SOLID PARTICLES

[76] Inventors: Charles C. Hager, Rte. 1, Box CF80, Crestwood, Ky. 40014; Warner Long, 9112 Tiverton Way, Louisville, Ky. 40223; George T. Hempenstall, 11104 Berwick Pl., Middletown, Ky. 40243

[21] Appl. No.: 120,817

[22] Filed: Feb. 12, 1980

[51] Int. Cl.[3] ..... B65B 1/04

[52] U.S. Cl. ..... 141/1; 141/93; 141/286; 55/97; 55/261; 55/467

[58] Field of Search ..... 141/51, 93, 1, 37–50, 141/52–66, 286; 55/97, 467, 261

[56] References Cited

U.S. PATENT DOCUMENTS

| | | | |
|---|---|---|---|
| 3,788,368 | 1/1974 | Geng et al. | 55/467 |
| 3,844,901 | 10/1974 | Roe et al. | 55/467 |
| 4,085,520 | 4/1978 | Lambert | 55/467 |

*Primary Examiner*—Houston S. Bell, Jr.
*Attorney, Agent, or Firm*—William R. Price

[57] ABSTRACT

A dust control apparatus in the form of a hood is disclosed for minimizing or eliminating the evolution of dust when loading dust laden solid discrete particles from a large container to a series of small containers. The apparatus is designed specifically for unloading spent catalysts from catalytic vessels into a series of drums without evolution of voluminous clouds of dust. The apparatus and method are designed to be portable so that expensive and sophisticated installations are not required in instances where the vessels are infrequently unloaded. The dust control hood makes use of the angle of repose of the solid discrete particles to be transferred in such manner that the drums do not overfill. Simultaneously air is drawn across the hood and the dust is collected in a suitable filter at a distance away from the loading area. Provision is also made for separation and collection of dust from pyrophoric materials utilizing an inert gas rather than air as the carrier medium.

19 Claims, 12 Drawing Figures

DUST CONTROL APPARATUS AND METHOD OF TRANSFERRING DUST LADEN DISCRETE SOLID PARTICLES

BACKGROUND OF THE INVENTION

1. Field of the Invention

The present invention relates to fluent material handling apparatus. More particularly, the present invention relates to drum loading devices for use in unloading of vessels which are only infrequently loaded. More specifically, this invention relates to the minimization and elimination of evolved dust when loading discrete solid particles from one vessel to a series of drums or other vessels.

2. Description of the Prior Art

Transfer of dust containing materials into containers has always presented problems due to the evolution of dust. In many instances, the dust can have adverse health effects on the personnel and in all instances, the dust cloud presents unsafe and aesthetically unpleasing problems. Dust control can be implemented by the use of fairly sophisticated equipment. However, the use of such equipment is not readily applicable to "on site" operation in which vessels are only infrequently unloaded. Examples of the more sophisticated types of loading equipment are shown in the patent to Mitchell, et al, U.S. Pat. No. 3,605,831, and in the connection device disclosed by Gebert in U.S. Pat. No. 2,298,119. In almost all instances, however, such apparatus is used for the unloading of feed chutes, chemical bins, and other installations in which a continuous loading operation is contemplated. Thus, such prior art equipment is designed for automatic weighing and dispensing of materials, including the provision of jolting apparatus to properly settle the pulverulent materials into the receiving drum. Such prior art apparatus, however, does not lend itself to "on site" operation and is not portable so as to be removable from one job to another. Furthermore, even with equipment used for temporary operations, there is a serious disadvantage in establishing when the receiving container is full. Therefore, if the dust control device has to be periodically removed to observe the level of filling, intermittent dust evolution occurs or the drum or receiving container overflows which can disrupt the entire operation.

SUMMARY OF THE INVENTION

The present invention overcomes the problems previously associated with the prior art by providing a dust control hood through which a current of air selectively entrains the dust evolved during the loading operation and removes it to a dust collector. The problem of determining when the drums or other containers are filled, so as to eliminate the periodic removal of the dust control hood, is quite simply solved by the use of a normally limp transfer hose feeding into the apparatus. A dip pipe, connected to the normally limp transfer hose extends from the top of the hood down into the container being filled so that when the level of the discrete solid reaches the level of the discharge end of the dip pipe, the normally limp transfer hose becomes rigid, and therefore observable to the operator. The operator, then, by merely manually squeezing off the hose, or by utilizing a quick disconnect clamp of some sort, can easily stop the flow of materials. Since the dip pipe extends down into the drum to about the level of the rim, or slightly above or below same, the angle of repose of the loaded material allows for additional room for more materials to be added. Thus, when the dust control hood is lifted the materials past the point of constriction in the transfer hose and/or in the dip pipe fall into the drum, filling the area provided through the natural angle of repose of the filled materials, without overfilling the drum. The lid can be quickly placed onto the filled drum. The operator then merely moves the dust control hood with the connected hoses to a waiting drum, releases the constricting pressure on the hose and allows the operation to continue.

Alternately, the transfer hose can be loosely inserted into the dip pipe opening and after the drum is filled and the hose squeezed off, the hose itself can be reinserted in the dip pipe of a second hood on an adjacent drum and the loading can be renewed. This allows for faster transfer from drum to drum and only requires one or more additional dust hoods. The use of this apparatus allows for fast loading of the various drums in a conveyerized operation or allows for the use of various commercially available switching devices.

DESCRIPTION OF THE PREFERRED EMBODIMENT

Figure 1:
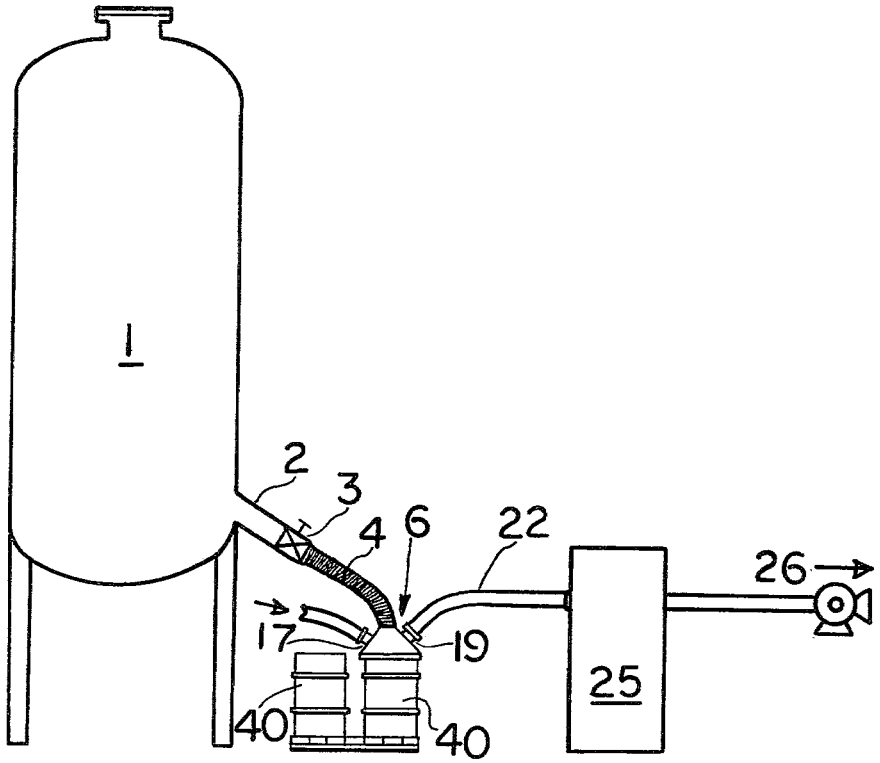
FIG. 1 is a semidiagrammatical view of the apparatus of this invention being used in unloading used catalyst from a catalytic vessel.

Referring now to FIG. 1, the apparatus and method of this invention is illustrated specifically in unloading used catalyst from a catalytic vessel 1 into a drum 40 or series of drums or other containers. While the dust control equipment has been described for use in unloading spent catalysts from catalytic vessels it may also be employed in founderies, mineral processing plants, coal processing plants, oil refineries, chemical plants and other industries in which dust containing discrete solids require transfer from one vessel or container to another. Further, while the invention has been described primarily as a portable method, it can be installed as a permanent unit for continuous or semi-continuous operation. However, one of the major advantages of the equipment and of the method is that they lend themselves readily for transportation from one area to another for intermittent or infrequent usage.

Referring, now to FIG. 1, a catalyst vessel 1 is shown having a dump chute 2 and a dump chute valve 3. A normally limp transfer hose 4 is connected to the dump chute 2 by use of a clamp (not shown) and the discharge end of the hose is operatively connected to the dust control hood 6. The dust control hood 6, as shown best in FIGS. 2 and 3, has a top 7, a wall portion 8 and a rim 9. Rim 9 contains a depending skirt 10 which in the embodiment shown in FIG. 2 contains a sealing ring 21.

At the top 7 of the dust control hood there is a dip pipe 11 having an opening 12 and a discharge end 13 which terminates at about the level of the depending skirt 10. The dip pipe can terminate at a point slightly above or below this level depending upon the natural angle of repose 27 of the materials being loaded. As illustrated, the transfer hose 4 can be fitted over the opening 12 of dip pipe 11, or merely inserted into the opening.

Figure 2:
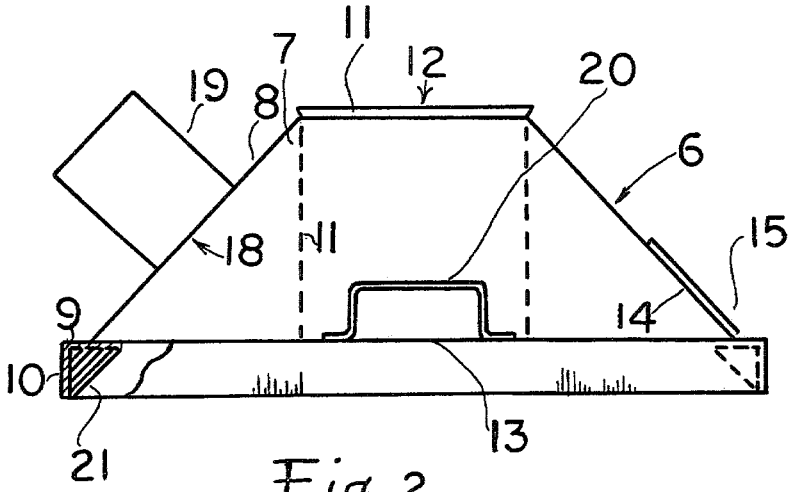
FIG. 2 is a side elevation of one embodiment of the device of this invention with a portion broken away for purposes of illustration.
Figure 3:
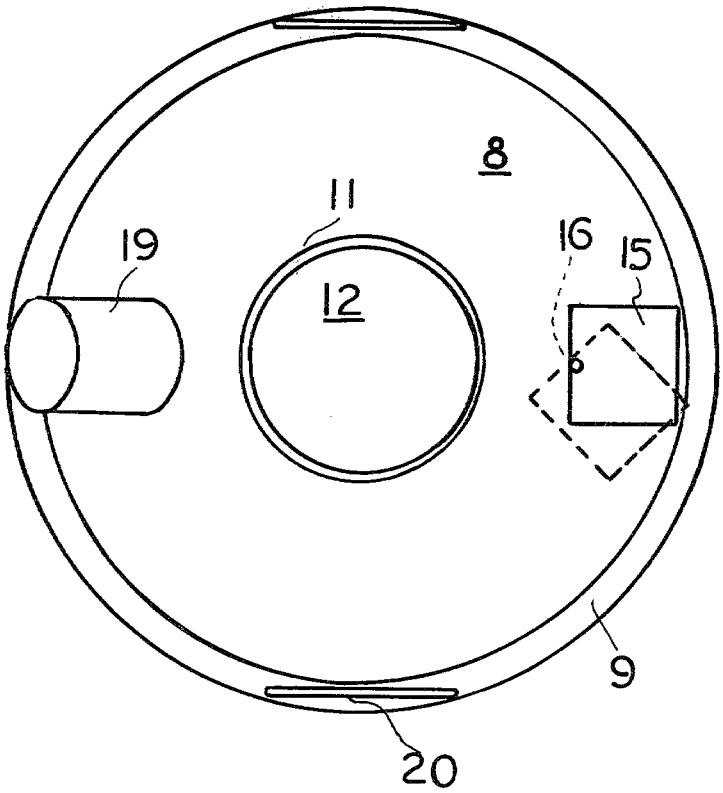
FIG. 3 is a plan view illustrating the device of this invention and particularly illustrating the use of an adjustable air inlet flap.
Figure 10:
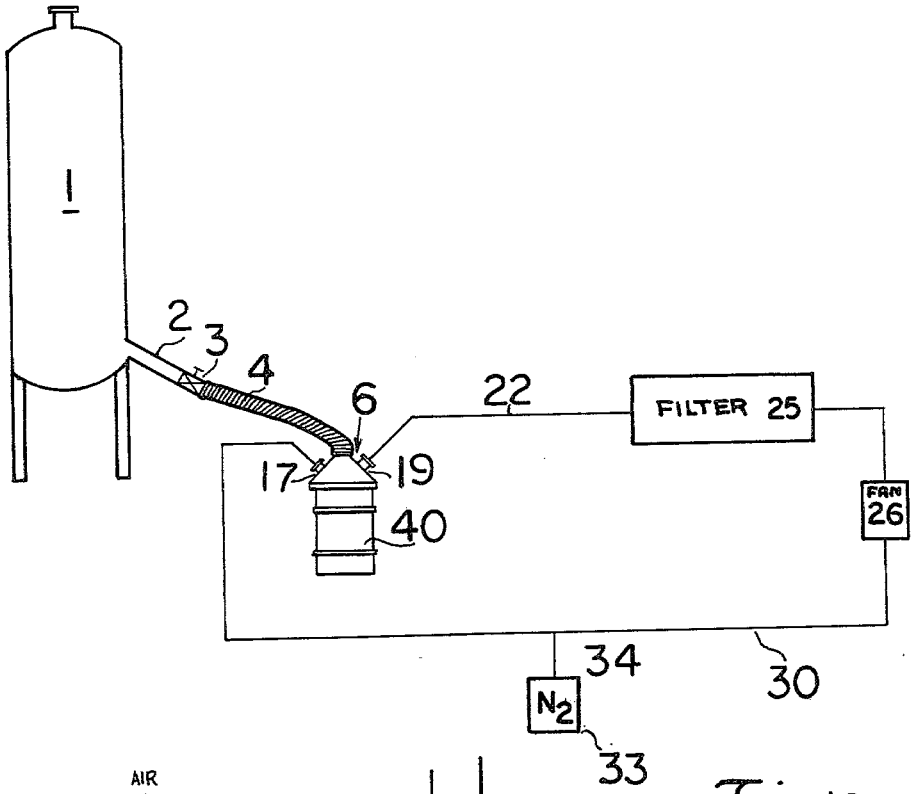
FIG. 10 is a schematic view of the use of the system and apparatus of this invention in unloading pyrophoric materials under a blanket of an inert gas.

In the embodiment illustrated in FIGS. 2 and 3 there is a gas inlet 14 which has an adjustable cover 15 in the form of a rubber flap which is pivotably attached at point 16 with a rivet for manipulation to either side. However, in the devices shown in FIGS. 1 and 10, the gas inlet is in the form of an inlet tube 17 which may be connected to a recycle line 30 for purposes to be described hereinafter.

Figure 4:
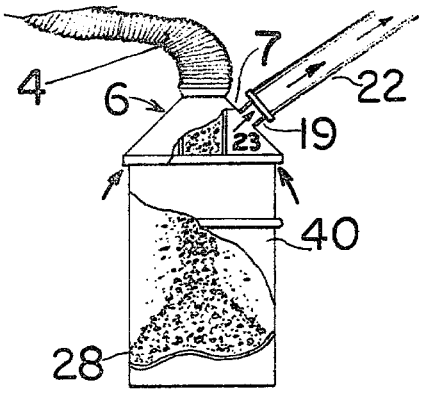
FIGS. 4 through 9 are fragmentary diagrammatic views illustrating step by step the use of the system and apparatus of this invention.
Figure 5:
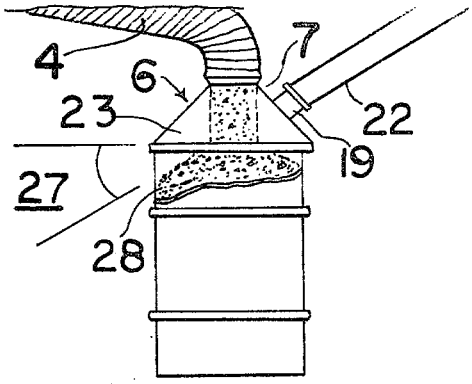
Figure 6:
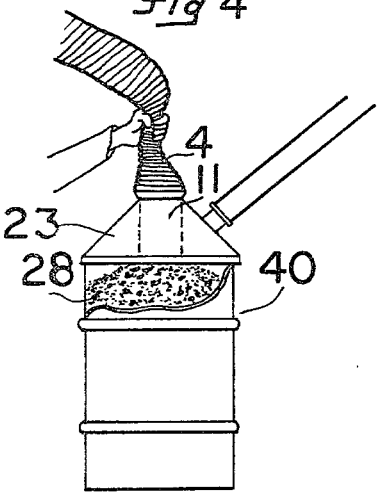
Figure 7:
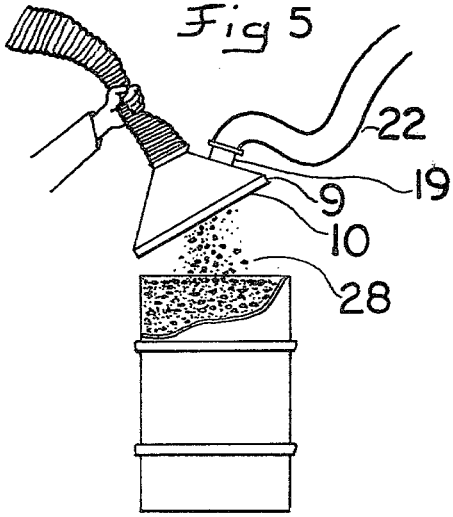
Figure 8:
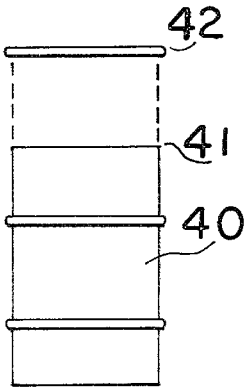
Figure 9:
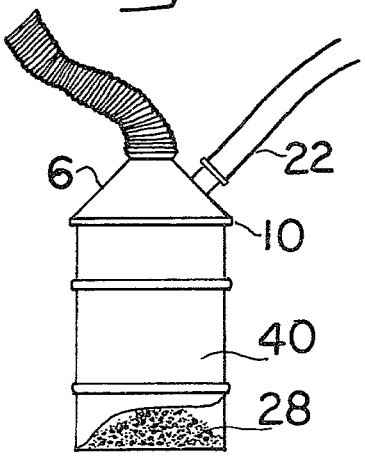

Furthermore, as illustrated in FIGS. 4 through 9, the gas inlet opening 14 can be completely eliminated by the elimination of the sealing ring 21 which allows for air to flow between the depending skirt 10 and the upper rim 41 of the drum 40. In any event, all that is required is that air or other gases be allowed to enter into the hood area while the dust laden materials are being loaded. As will be apparent, the dust which evolves from the discrete dust laden pieces being loaded into the drum 40 is entrained into the air stream flowing across plenum 23 between the hood 6 and the drum and which escapes via outlet 18 through outlet tube 19 into the outlet line 22. This air is pulled by means of fan 26 through the dust collector 25, preferably in the form of a bag filter, and the exhaust air thereafter is discharged to the atmosphere (or recycled in the case of inert gases). Referring now to drawings 4 through 9, the air is shown by the arrows entering between the depending skirt 10 and the upper rim 41 of the drum 40 and sweeping across the plenum 23 of the hood through the outlet tube 19 into outlet line 22 to the filtering apparatus (not shown). The transfer hose 4 is shown in limp condition as the pulverulent solids and dust are loaded into the bottom of the drum. However, as is shown in FIG. 5, once the solids 28 have reached the discharge end 13 of the dip pipe 11, the normally limp transfer hose 4 becomes rigid and is readily observable by the operator. Thereafter, as is shown in FIG. 4, the operator can manually squeeze off or close off the transfer hose 4 thus stopping the flow of materials 28 into the drum 40. The natural angle of repose of the loaded materials (indicated at 27) allows for additional material to be loaded into the drum without overfilling and this is accomplished when the operator pulls the hood 6 and attached hoses 4 and 22 away from the drum. This is shown in FIG. 7 as allowing the materials in the dip pipe 13 and in the transfer hose 4 past the point of constriction to fall into the drum 40. Thereafter the lid 42 can be easily placed onto the drum as is shown in FIG. 8 and the hood 6 and attached hoses are immediately transferred to a waiting container as is shown in FIG. 9. Handles have been provided for this purpose.

As has previously been mentioned, the transfer hose 4 need not be physically attached to the dip pipe 11 but can merely be inserted therein. Thus, in this case, the operator will provide two or more dust control hoods 6 for two or more drums 40 and merely lift the transfer hose upwardly after applying constricting pressure and thus allow the residual materials to flow into the drum through the open dip pipe 11. Thereafter, the hose is inserted into the dip pipe 11 of a waiting hood 6 on an adjacent drum 40 and the pressure released so as to allow the flow to again resume to the new drum. As will be obvious to artisans in this art, slide valves can be used rather than manually squeezing off the transfer hose or other methods can be devised for stopping the flow when the transfer hose shows, through its rigidity, that the drum is filled. Furthermore, the outlet line 22 may be through a manifold, with closure valves in the case of multiple hoods for multiple drums. Since all of this is within the skill of the art, further description is not deemed necessary.

In some instances, as has previously been alluded to, the materials being transferred are pyrophoric and will burst into flame upon exposure to air. In these instances, a method such as that disclosed in FIG. 10, may be used wherein an inert gas is used to blanket the materials being loaded to the container. The inert gas, as for example nitrogen or carbon dioxide, can be fed through the inlet tube 17 to purge the drum 40. The inert gas is then fed through exhaust tube 19 through exhaust line 22 to the dust collector 25. In this instance, however, the fan 26 rather than exhausting to the atmosphere propels the gases back through recycle line 30 which is connected to the inlet tube 17. A make up of nitrogen or $CO_2$ can be fed from cylinder 33 via line 34 to the recycle line through a T arrangement, (not shown). Thus it is possible, with the use of the method and apparatus of this invention, to safely and successfully transfer dangerous pyrophoric materials containing pyrophoric dust to drums without danger of conflagration.

In some instances, in the transfer of extremely highly pyrophoric materials, such as RANEY NICKEL and the CATALYTIC RICH GAS (CRG) CATALYSTS, the dust is so highly pyrophoric, that there is a danger of a fire in the filter bags in the "bag house". This would occur, when the hood, is lifted from the drum and oxygen in the area would be withdrawn through the outlet line 22 to the filter. This catalyst dust, holding absorbed hydrogen atoms, in an extremely active state, readily combine with oxygen or other oxidizing materials at atmospheric temperatures.

Figure 11:
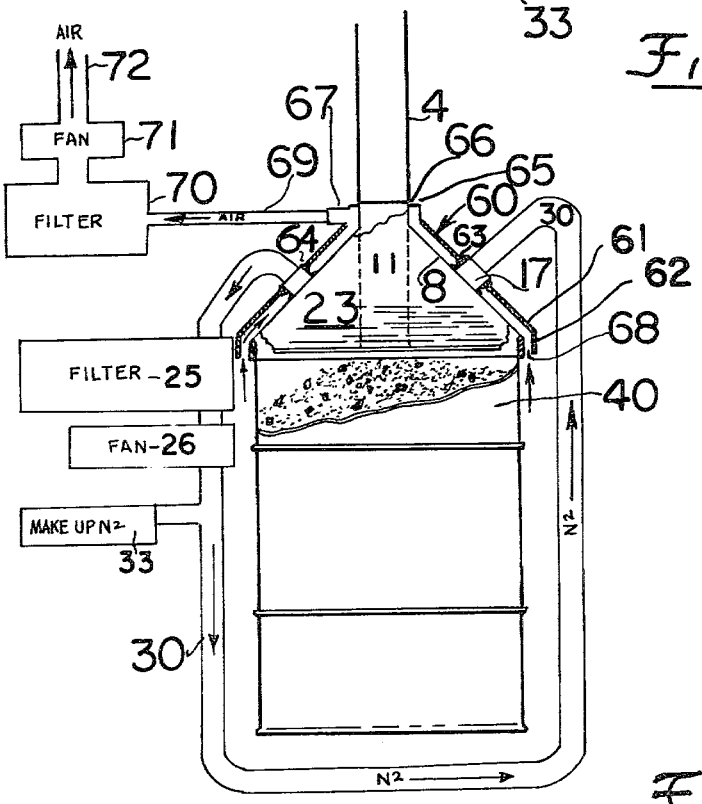
FIG. 11 is a diagrammatic view of the use of the process and apparatus in this invention in handling highly pyrophoric material so as to allow for collection of the highly pyrophoric dust while minimizing the danger of a fire in the bag house.
Figure 12:
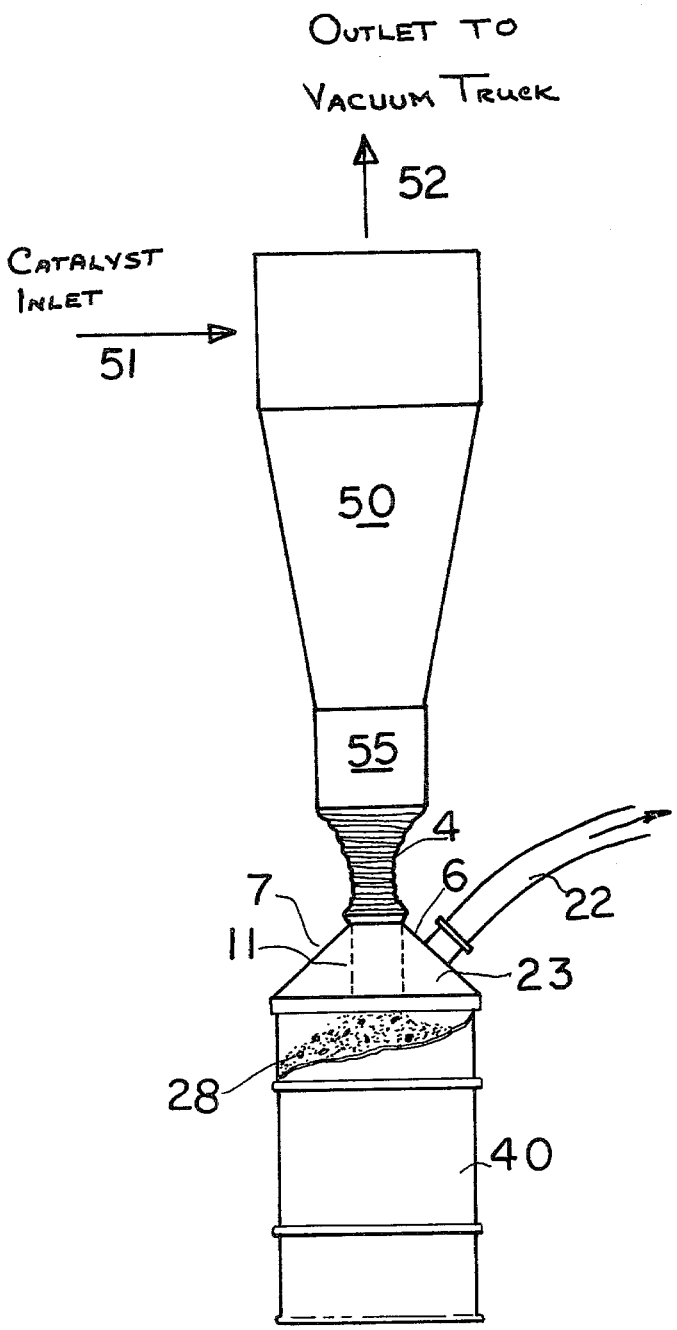
FIG. 12 is a fragmentary view of the apparatus of this invention used in conjunction with a vacuuming process whereby dust is preferentially separated from discrete solid particles.

Thus, in order to avoid this possibility we have devised the device and system shown in FIG. 11. Essentially, the principle is the same in that the transfer hose 4 feeds the pyrophoric material from its source to the drum 40 through the dip pipe 11 of hood 6. However, there has been added an additional member in the form of a conical member 60 containing an outer wall 61 and a depending flange 62. The inlet pipe 17, is welded through weldments 63 to the outer wall portion 61 and at 63 to the inner wall portion 8 so as to space the conical member 60 in spaced relation to the inner wall 8 of the original hood 6. In the same manner, outlet tube 19 is welded both to the inner wall 8 and the outer wall 61 by weldments 64. Other suitable spacers may be utilized. The conical top piece 60 terminates into a neck portion 65 which is connected to an annular disc 66 which closes the conical piece hermetically around the neck of the original hood 6. The neck portion contains an outlet pipe 67 which allows air to run from the annular space or plenum 68 between the inner wall 8 and the outer wall 61. Thus, the plenum 68 is in communication with the atmosphere surrounding the drum 40 and with the neck portion and with the outlet pipe 67 of the conical piece 60.

The outlet line 69 goes to a second filter 70 which is connected in series with fan 71 which is then exhausted through line 72 to the atmosphere. The inert gases, recirculated through line 22 and through line 30 to the inlet 14 of the hood 6 passes through plenum 23 through outlet 19 back through the outlet line 22 to the filter 25. The fan 26 connected in series pulls the nitrogen through the recirculating line 30 and make up nitrogen is added at point 33. A positive pressure of nitrogen is maintained through the system so that when the hood 6 is lifted from the top of the drum 40, any residual dust around the rim 41 is drawn into the annular space 68 of the conical top piece 60. Therefore, any residual pyrophoric dust is picked up through the plenum 68 afforded by the conical top piece 60 and is pulled with the surrounding air through a outlet pipe 67 and through the outlet line 69 to the filter system 70. This dust will oxidize. However, due to the small amount of the dust and the high volume flow of air through the plenum, the heat will be sufficiently absorbed so that fire is not a problem in the filter system 70. It will be appreciated of course, that the majority of the pyrophoric dust is collected in the filter 25 which is constantly blanketed with an inert gas nitrogen so as to prevent any oxidation or any fear of conflagration.

In the event that a vacuuming technique is utilized to unload the container rather than a gravity feed system, it is still possible to utilize the dust control apparatus as is shown in the illustration in FIG. 11. In this instance, the dust containing solids 28 are fed through inlet 51 into a cyclone 50, whereby the solid particles 28 for the most part are separated from the pulverant dust containing materials. The dust, entrained in the low pressure gases, is fed through outlet 52 back to the vacuum truck for collection in the bag filter located therein whereas the solid materials 28 are fed through a vacuum break 55, in the form of a rotary air lock or gate valve and into the normally limp transfer hose 4 to the dust control hood 6. This operation illustrates again the outlet line 22 leading to the dust collector apparatus and the fan not shown so that any dust not separated in the cyclone is eliminated from evolution at the point of transfer.

It will be apparent, that many modifications will occur to those skilled in the art from the detailed description herein given. As previously mentioned, the use of this apparatus and method is not limited to unloading spent catalysts from catalytic reactors, but may find wide use in foundry operations, chemical plant operations, coal processing plants, feed and grain operations, and other industries in which the transfer of dust laden solids from one point to another offers safety, health and aesthetic problems. For these reasons, the detailed description, herein given, should be construed as being exemplary in nature and nonlimiting except so as to be commensurate in scope with the appended claims.

We claim:

1. Dust control apparatus for minimizing dust evolution in transferring dust laden solid discrete particles from a first source to a series of receiving containers which comprises, in combination:

A. a normally limp transfer hose in communication with a first source,

B. a hood for covering the outer rim of a receiving container including, 1. a top portion,
2. a depending wall portion,
3. a rim portion for registry over the open top of a receiving container,
4. a dip pipe opening into the top portion of said hood and extending downwardly to a discharge end near the top of said receiving container,
5. a gas inlet and
6. a gas outlet C. exhaust means including:

1. a gas outlet line connected to said gas outlet and
2. a fan in communication with said gas outlet line D. dust collecting means in operative relation with said gas outlet line and said fan.

2. Dust control apparatus as defined in claim 1, the further combination therewith of closure means for use in closing off said transfer hose.

3. Dust control apparatus as defined in claim 1, in which said hood contains a handle for lifting said hood from said receiving container for transfer to a second receiving container.

4. Dust control apparatus as defined in claim 1, in which said hood contains an adjustable gas inlet opening for controlling the amount of gas directed across the op of said hood to said gas outlet.

5. Dust control apparatus, as defined in claim 1, in which said hood contains a gas inlet port.

6. Dust control apparatus, as defined in claim 4, in which said gas inlet port has a flap which may be adjustably opened or closed for controlling the volume of air drawn across the hood.

7. Dust control apparatus, as defined in claim 1, in which said hood contains an inspection port.

8. Dust control apparatus, as defined in claim 1, the further combination with said transfer hose of a quick release clamp.

9. Dust control apparatus, as defined in claim 1, the further combination therewith, of a gasket surrounding said depending rim portion of said hood for forming a gas tight seal with the rim of said receiving container.

10. A dust control apparatus as defined in claim 9, the further combination therewith of an inert gas return line, connected at one end to said gas outlet and at the other end to said gas inlet for forming a continuous gas loop.

11. A dust control apparatus as defined in claim 10, the further combination therewith of a source of make-up inert gas for said gas loop.

12. Dust control apparatus, as defined in claim 1, in which said hood comprises:

A. an outer wall portion in spaced relation with said depending wall portion;

B. an annular space between the two wall portions, defining an annual gas plenum;

C. a gas inlet at the bottom of said plenum in communication with said annular gas passage;

D. an upper neck portion surrounding said dip pipe;

E. an annular disc hermetically sealing said upper neck portion to said inner wall portion and joined to the top part of said upper neck portion;

F. a gas outlet pipe in communication with said plenum and said gas inlet;

G. a second filter in communication with said gas outlet and a fan for pulling gas through said annular gas passage and thereafter through said second filter.

13. Dust control apparatus, as defined in claim 12, which comprises further:

A. a gas inlet tube opening into the inner of the wall portions extending outside of the outer wall portions;

B. a gas outlet tube, opening into the inner of the wall portions and extending outside of the other wall portion;

C. a continuous gas loop comprising;

1. a recycle line connected to said gas inlet tube and said gas outlet tube and in communication with said dust collector and first fan;
2. a source of make up inert gas for recirculation through said continuous gas loop.

14. A method of transferring dust laden discrete solid particles from a first source to a series of smaller containers through a normally limp transfer hose in operative relation to said first source, the improvement of minimizing the evolution of dust within the transfer area and of transferring evolved dust via an outlet hose and fan to a dust collector away from said transfer area, which comprises the steps of:

A. placing a hood over the open top of the first of a series of smaller containers, said hood comprising:

1. a top portion, wall portions and a rim portion, in which:
   a. said wall portion depends from said top portion and terminates in a rim portion,
   b. said rim portion fits over the top rim of the smaller container;
   c. a dip pipe opening in the top portion of said hood and connected to said normally limp transfer hose and extending downwardly to terminate as a discharge end;
   d. a gas inlet,
   e. a gas outlet for connection to said outlet hose and fan;

B. loading said discrete particles from said first source into smaller containers through said limp transfer hose and said dip pipe, C. drawing a gas stream through said gas inlet and across said hood to selectively entrain dust in said gas stream, D. drawing gas and entrained dust from said hood and from said receiving container through said outlet hose to said dust collector and collecting dust in said dust collector, E. constricting said normally limp transfer hose at a point above the dip pipe as said transfer hose becomes rigid from the transferred solid discrete particles contained therein;

F. lifting the entire hood and connected hoses and allowing the collected solid discrete particles in the dip pipe and in the transfer hose past the point of clamping constriction to fall into the filled container without overfilling said container;

G. placing the hood onto a waiting empty container and fitting the depending skirt over the upper rim thereof;

H. releasing the constriction pressure from the transfer hose to resume the transfer operation.

15. A method of transferring dust laden discrete solid particles from a first source to a series of smaller containers through a normally limp transfer hose in operative relation to said first source, the improvement of minimizing the evolution of dust within the transfer area and of transferring evolved dust via an outlet hose and fan to a dust collector away from said transfer area, which comprises, the steps of:

A. placing a hood over the open top of two or more of a series of smaller containers, each of said hoods comprising:

1. a top portion, wall portions and a rim portion, in which:
   a. said wall portion depends from said top portion and terminates in a rim portion,
   b. said rim portion fitting over the top rim of a smaller container;
   c. a dip pipe opening in the top portion of said hood and extending downwardly to terminate as a discharge end;
   d. a gas inlet,
   e. a gas exhaust for connection to said exhaust hose and fan;

B. placing said transfer hose into the dip pipe of the first of said hoods;

C. loading said discrete particles from said first source into smaller containers through said limp transfer hose and said dip pipe;

D. drawing a gas stream through said gas inlet and across said hood to selectively entrain dust in said gas stream, E. drawing gas and entrained dust from said hood and from said receiving container through said exhaust hose to said dust collector and collecting dust in said dust collector.

F. constricting said normally limp transfer hose at a point above the dip pipe as said transfer hose becomes rigid from the transferred solid discrete particles contained therein;

G. lifting the transfer hose out of said dip pipe and allowing the collected solid discrete particles in the transfer hose past the point of constriction to fall into the filled container without overfilling said container;

H. placing the transfer hose into the dip pipe of a hood on a waiting empty container.

I. releasing the constricting pressure on the transfer hose to resume the transfer operation.

16. A method of transferring dust laden discrete solid particles, as defined in claim 14, in which the hood contains an adjustable gas inlet, the improvement of:

A. adjustably opening said air inlet;

B. controlling the velocity of the gas stream pulled by said fan through said gas inlet across the hood to said exhaust line and;

C. selectively entraining dust particles as the solid discrete particles are loaded into said smaller container.

17. A method of transferring dust laden discrete solid particles, as defined in claim 14 in which said dust laden discrete solid particles are pyrophoric when exposed to air, the improvement which comprises:

A. sparging an inert gas through said hood and into said empty container prior to the transfer operation;

B. continuing said sparging operation through said hood during the filling operation;

C. selectively entraining said pyrophoric dust into said inert gas;

D. collecting said pyrophoric dust in a dust collector;

E. thereafter, discharging said inert gas from said dust collector.

18. A method of transferring dust laden discrete particles, as defined in claim 15, the further improvement of recycling said inert gas from said filter apparatus back to the sparging operation and adding makeup inert gas for the gas lost in the process.

19. A method of transferring dust laden discrete particles of highly pyrophoric materials, which comprises the steps of:

A. loading said pyrophoric material through a transfer hose to a container closed with a dust control hood;

B. establishing a plenum chamber between said hood and said container;

C. circulating an inert gas through plenum, out of said hood to a closed gas loop comprising in a series;

1. a filter;
2. a fan;
3. a source of make up gas;
4. and thence back to said hood.

D. collecting said pyrophoric dust in said filter beneath a blanket of inert gas;

the improvement which comprises:

E. providing a second plenum outside said dust control hood;

F. drawing ambient air through said plenum to an exhaust line;

G. drawing said air from said plenum through a second filter;

H. lifting said hood from said container when filled;

I. entraining any excess pyrophoric dust in said stream of ambient air drawn into said plenum;

J. oxidizing said excess pyrophoric dust in said second plenum and in said filter system;

K. disipating excess heat of oxidation through the use of excess volumes of air throughout the plenum and filtration system.

* * * * *